US010954735B2

(12) United States Patent
Fripp et al.

(10) Patent No.: US 10,954,735 B2
(45) Date of Patent: Mar. 23, 2021

(54) DEGRADABLE WINDOW FOR MULTILATERAL JUNCTION

(71) Applicant: Halliburton Energy Services, Inc., Houston, TX (US)

(72) Inventors: Michael Linley Fripp, Carrollton, TX (US); Mark C. Glaser, Houston, TX (US); Richard Decena Ornelaz, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/483,744

(22) PCT Filed: Sep. 14, 2018

(86) PCT No.: PCT/US2018/051186
§ 371 (c)(1),
(2) Date: Aug. 5, 2019

(87) PCT Pub. No.: WO2020/055431
PCT Pub. Date: Mar. 19, 2020

(65) Prior Publication Data

US 2020/0362656 A1 Nov. 19, 2020

(51) Int. Cl.
*E21B 29/02* (2006.01)
*E21B 29/06* (2006.01)

(52) U.S. Cl.
CPC ..... *E21B 29/02* (2013.01); *E21B 29/06* (2013.01)

(58) Field of Classification Search
CPC ..... E21B 29/02; E21B 29/06
See application file for complete search history.

(56) References Cited

U.S. PATENT DOCUMENTS

| | | | |
|---|---|---|---|
| 5,322,127 | A | 6/1994 | McNair et al. |
| 5,887,668 | A | 3/1999 | Haugen et al. |
| 6,105,675 | A | 8/2000 | Buytaert et al. |

(Continued)

FOREIGN PATENT DOCUMENTS

| | | |
|---|---|---|
| GB | 2316424 | 2/1998 |
| WO | 2017138923 | 8/2017 |

OTHER PUBLICATIONS

ISRWO International Search Report and Written Opinion for PCT/US2018/051186 dated Jun. 14, 2019.

(Continued)

*Primary Examiner* — Kristyn A Hall
(74) *Attorney, Agent, or Firm* — Scott Richardson; C. Tumey Law Group, PLLC

(57) ABSTRACT

This disclosure may generally relate to drilling operations and, more particularly, to systems and methods for side-tracking an existing well. Specifically, examples of the present disclosure may include creating a window by introducing a pH-modifying fluid downhole to degrade a portion of a casing string, thereby creating the window through which a secondary wellbore may be drilled. A method for creating a window in an oilfield tubular may comprise of providing a pH-modifying fluid in the oilfield tubular disposed in a wellbore and contacting a degradable section of the oilfield tubular with the pH-modifying fluid to degrade at least a portion of the degradable section and form an exit window in the oilfield tubular.

20 Claims, 6 Drawing Sheets

(56) References Cited

U.S. PATENT DOCUMENTS

| | | | | |
|---|---|---|---|---|
| 6,668,945 | B2 | 12/2003 | Ohmer | |
| 6,732,802 | B2 | 5/2004 | Smith | |
| 7,810,568 | B2 | 10/2010 | Toulouse | |
| 8,678,092 | B2 | 3/2014 | Assal et al. | |
| 2006/0027359 | A1 | 2/2006 | Carter et al. | |
| 2008/0296029 | A1* | 12/2008 | Ortiz | E21B 33/1208 166/381 |
| 2010/0147520 | A1 | 6/2010 | Freyer | |
| 2013/0048305 | A1* | 2/2013 | Xu | E21B 23/01 166/376 |
| 2014/0190685 | A1 | 7/2014 | Frazier et al. | |
| 2016/0084047 | A1 | 3/2016 | Carmody et al. | |
| 2016/0326818 | A1* | 11/2016 | Lajesic | E21B 41/0042 |
| 2016/0348455 | A1 | 12/2016 | Haq et al. | |
| 2017/0204697 | A1* | 7/2017 | Fripp | E21B 33/129 |
| 2019/0316449 | A1* | 10/2019 | Schultz | E21B 43/116 |

OTHER PUBLICATIONS

Aquatic Company, Moscow, Russia, Implement Russian Aluminum Drill Pipe and Retractable Drilling Bits into the USA, vol. I: Development of Aluminum Drill Pipe in Russia. Aug. 1999.

Oberkircher, "New system reduces multilateral completion time", Drilling Contractor, 2000.

* cited by examiner

DEGRADABLE WINDOW FOR MULTILATERAL JUNCTION

BACKGROUND

Wells may be drilled into subterranean formations to recover valuable hydrocarbons. Various operations may be performed before, during, and after the well has been drilled to produce and continue the flow of the hydrocarbon fluids to the surface.

A typical operation concerning oil and gas operations may be to drill a secondary wellbore away from an original wellbore, often referred to as "sidetracking." Sidetracking a well may include creating a window, or a hole, in the casing of the original wellbore and drilling out of that window through subterranean formations to form a secondary wellbore. This may be done intentionally or accidentally. There may be a number of reasons why it may be desirable to sidetrack a wellbore. The operation may be required if there is an object or tool stuck in the original wellbore that cannot be fished out, the wellbore has collapsed, there is a desire to bypass a section of the original wellbore, or a new subterranean formation is to be explored nearby wherein a lateral wellbore may increase the contact with a reservoir and thereby increase the rate of production. Traditionally, the process of sidetracking a wellbore may require multiple tool assemblies and steps that take time for completing the operation, and the casing strings that line the drilled-out wellbore may be made of strong, durable material. Typically, a milling assembly may be used to create the window by drilling through the casing strings. It may be suitable to replace the milling operation with a different process as the milling operation requires an additional trip of disposing a separate tool downhole and creates mill cuttings from the material of the casing strings.

BRIEF DESCRIPTION OF THE DRAWINGS

These drawing's represent certain aspects of the present invention and should not be used to limit or define the disclosure.

DETAILED DESCRIPTION

This disclosure may generally relate to drilling operations and, more particularly, to systems and methods for sidetracking an existing well. Specifically, examples of the present disclosure may include creating a window by introducing a degradation fluid downhole to degrade a portion of a casing string, thereby creating the window through which a secondary wellbore may be drilled.

A system and method may be used to create a window within a casing string of a well. A packer may be used in conjunction with a whipstock to guide a degradation fluid towards a designated portion of a casing string. The whipstock may direct the flow of the degradation fluid to travel towards a dissolvable window formed in the casing string made of a material that will degrade upon interaction with the degradation fluid. Additional tools and equipment may be used to seal the whipstock against the casing string prior to the introduction downhole of a pH-modifying fluid that dissolves or otherwise degrades the dissolvable window so as to limit the pH-modifying fluid from coming into contact with an unintended piece of equipment and/or portion of the casing string.

Figure 1:
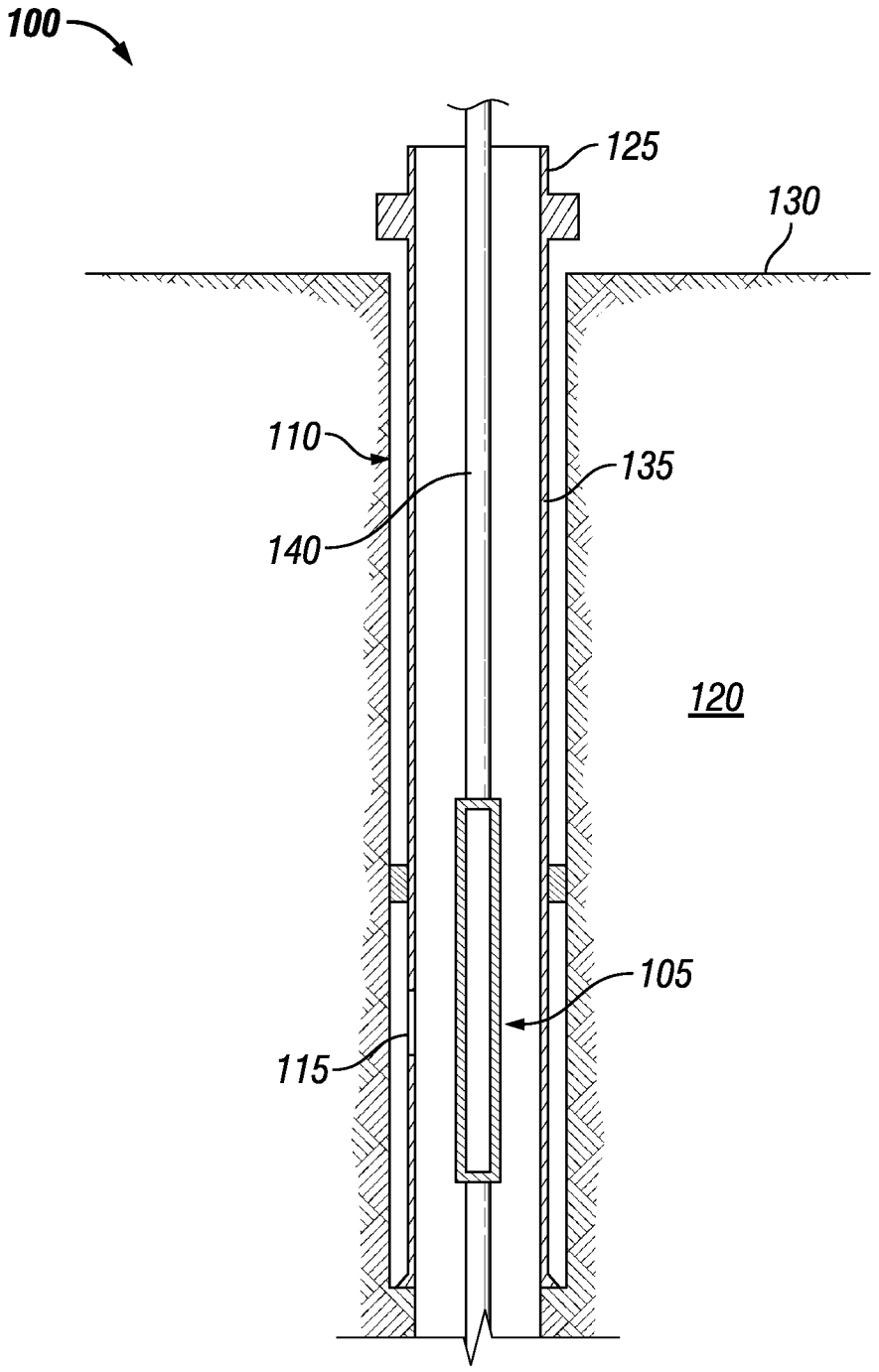
FIG. 1 illustrates an example of a downhole system.

FIG. 1 illustrates an example of a downhole system 100 that includes a bottom hole assembly 105. As illustrated, a bottom hole assembly 105 may be disposed in wellbore 110. After completion of wellbore 110, it may be desirable to extend outwards from wellbore 110. In other words, it may be desired to sidetrack wellbore 110 by creation of a second wellbore that extends from wellbore 110. There may be numerous reasons why an operator may want to do so, such as, discovering a nearby area of interest and/or dwindling production. Bottom hole assembly 105 may be utilized, in conjunction with a pH-modifying fluid, to create an exit window 115, wherein exit window 115 may be a hole or opening along the side of wellbore 110. Without limitation, the length of exit window 115 may be from about 3 feet (91.44 cm) to about 40 feet (12.192 m). In examples, the length of exit window 115 may be about the same as the length of a whipstock (described below). Without limitation, the exit window diameter (or width) of exit window 115 may be from about 2.5 inches (6.35 cm) to about 18 inches (45.72 cm). In examples, exit window 115 may be in the shape of a tear drop. In alternate examples, exit window 115 may be in the shape of an upside down tear drop. As a milling assembly (not illustrated) travel along the face of a whipstock, the length and/or width of the shape of exit window 115 may vary. Concerning the present disclosure, exit window 115 may be formed in a varying shape when compared to using a milling assembly. Further drilling operations through exit window 115 may be desired, and subsequent drilling equipment may be implemented to explore a nearby formation 120, for example, by creation of a secondary wellbore that extends from wellbore 110 through exit window 115.

With continued reference to FIG. 1, wellbore 110 extends from a wellhead 125 at a surface 130 downward into the Earth into one or more formations 120. A portion of wellbore 110 extending from wellhead 125 to formation 120 is lined with lengths of tubing, called oilfield tubular 135. Oilfield tubular 135 may be in the form of an intermediate casing, a production casing, a liner, coiled tubing, or other suitable conduit, as will be appreciated by those of ordinary skill in the art. In some examples, oilfield tubular 135 may be any suitable casing string. While not illustrated, additional conduits may also be installed in wellbore 110 as desired for a particular application. In examples, oilfield tubular 135 may be cemented to the walls of wellbore 110.

A conveyance line 140 is shown as having been lowered from surface 130 into wellbore 110. Conveyance line 140 may include any suitable means for providing mechanical conveyance for bottom hole assembly 105, including, but not limited to, wireline, slickline, coiled tubing, pipe, tool string, drill pipe, drill string or the like. In some examples, conveyance line 140 may provide mechanical suspension, as well as electrical connectivity, for bottom hole assembly 105. Conveyance line 140 may lower bottom hole assembly 105 through wellbore 110 to a desired depth.

As illustrated, wellbore 110 may extend through formation 120 and/or a plurality of formations 120. While wellbore 110 is shown extending generally vertically into formation 120, the principles described herein are also applicable to wellbores that extend at an angle through formation 120, such as horizontal and slanted wellbores. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without deviling from the scope of the disclosure.

Figure 2:
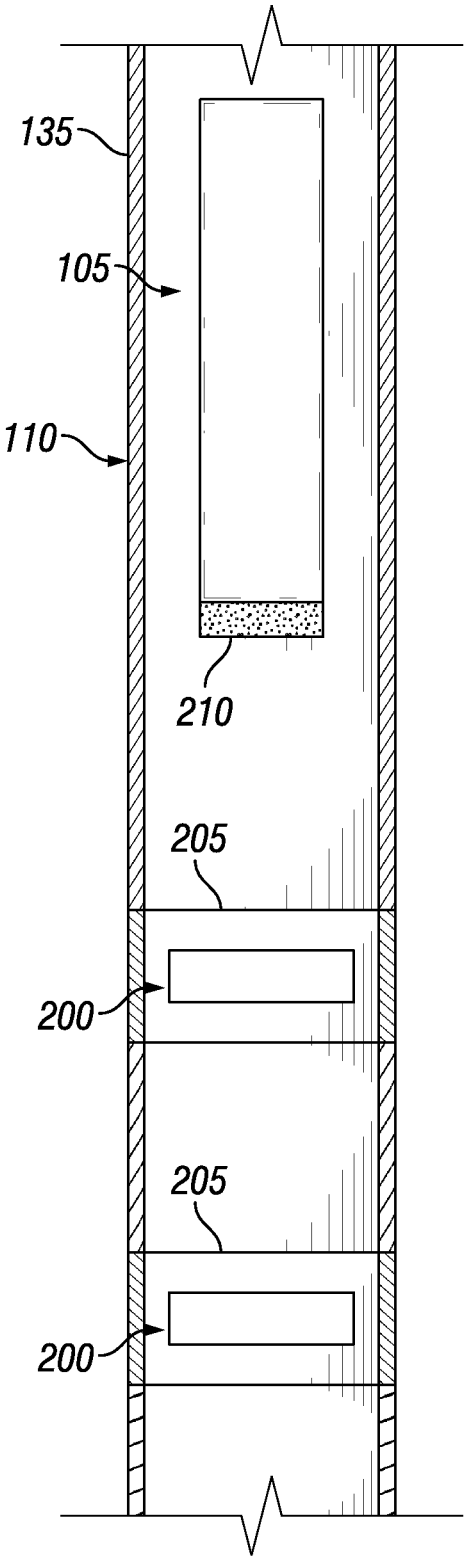
FIG. 2 illustrates an example of a bottom hole assembly.

FIG. 2 illustrates an example of securing bottom hole assembly 105 in wellbore 110. During operations, bottom hole assembly 105 may be lowered into wellbore 110. Once bottom hole assembly 105 reaches a specified depth, bottom hole assembly 105 may need to be secured so as to prevent further displacement. A profile device 200 may be implemented to prevent bottom hole assembly 105 from rotation and/or translation.

Profile device 200 may receive an end or a portion of an end of bottom hole assembly 105. As illustrated, there may be a plurality of profile devices 200 disposed in wellbore 110. Profile device 200 may be pre-installed in wellbore 110 on oilfield tubular 135 and/or installed in an existing wellbore 110 on oilfield tubular 135. Profile device 200 may be any suitable size, height, and/or shape which may accommodate the end or the portion of an end of bottom hole assembly 105. Without limitation, a suitable shape may include, but is not limited to, cross-sectional shapes that are circular, elliptical, triangular, rectangular, square, hexagonal, and/or combinations thereof. Profile device 200 may be made from any suitable material. Suitable materials may include, but are not limited to, metals, nonmetals, polymers, ceramics, and/or combinations thereof.

In examples, profile device 200 may be cylindrical and may have an inner and outer diameter. There may be an opening 205 that traverses the length from one end of profile device 200 to the other to allow, for example, objects or tools to pass through profile device 200 in wellbore 100. In examples, there may be surface features, such as protrusions (e.g., ridges) and/or depressions (e.g., grooves), running along the inner diameter of profile device 200. The surface features may accommodate a latch coupling 210 disposed about the distal end of bottom hole assembly 105. While more than one of the profile device 200 is shown in wellbore 110, the latch coupling 200 may be configured to interact with only one profile device 200, for example, at a specific depth in wellbore 100. In examples, bottom hole assembly 105 may enter into opening 205 through an end of profile device 200. The surface features of profile device 200 may interact with latch coupling 210 to secure bottom hole assembly 105 in wellbore 100. In examples, bottom hole assembly 105 may latch into place within profile device 200.

Profile device 200 may be disposed as a part of oilfield tubular 135 of wellbore 110. Profile device 200 may be disposed as a part of oilfield tubular 135 using any suitable mechanism, including, but not limited, through the use of suitable fasteners, threading, adhesives, welding and/or any combination thereof. Without limitation, suitable fasteners may include nuts and bolts, washers, screws, pins, sockets, rods and studs, hinges and/or any combination thereof.

In other examples, profile device 200 may be integrated into a packer (not illustrated) and installed in the post-well construction of wellbore 110. During operations, as the packer may be disposed through wellbore 110, profile device 200 may be displaced accordingly. As the packer anchors itself to oilfield tubular 135 of wellbore 110, profile device 200 may remain stationary within wellbore 110. In examples, the packer may provide additional support to hold bottom hole assembly 105 in place once latch coupling 210 engages with profile device 200.

Figure 3:
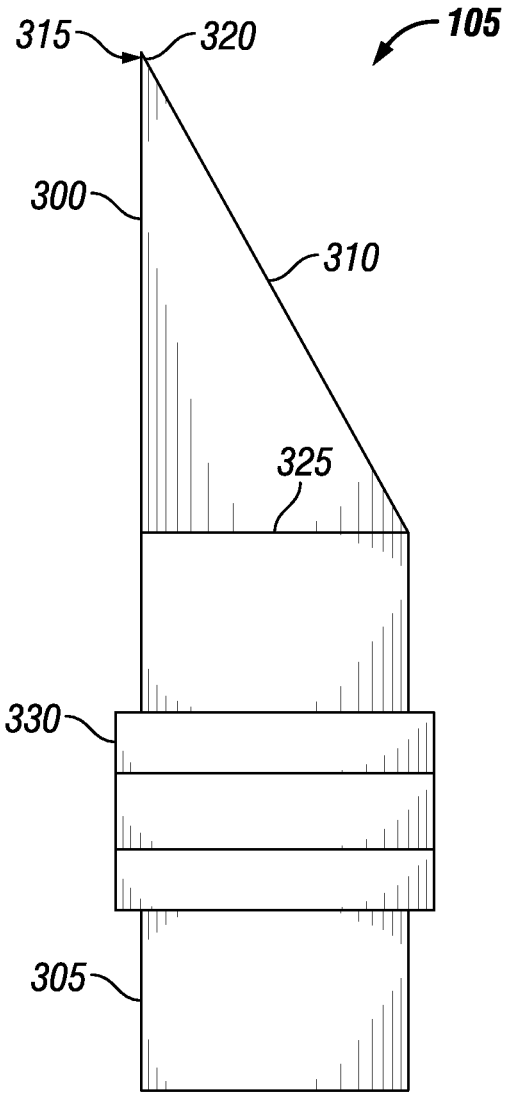
FIG. 3 illustrates an example of a whipstock and a packer.

FIG. 3 illustrates an example of bottom hole assembly 105. Bottom hole assembly 105 may comprise a whipstock 300 and a packer 305. In typical operations, whipstock 300 may serve to direct a milling assembly (not illustrated) into oilfield tubular 135 (referring to FIG. 1) of wellbore 110 (referring to FIG. 1) in order to drill through oilfield tubular 135. There may be a face 310 of whipstock 300 that is exposed to a portion of oilfield tubular 135. Face 310 may be an inclined ramp. Traditionally, the milling assembly would traverse along face 310 of whipstock 300 towards a pre-selected portion of oilfield tubular 135 to be drilled through. In examples, the milling assembly may be removed and a drilling assembly may be introduced downhole to drill a lateral wellbore starting from exit window 115 (e.g., referring to FIG. 1). A secondary oilfield tubular 135 may be run downhole through exit window 115 (e.g., referring to FIG. 1) to line the newly drilled lateral wellbore. Concerning the present disclosure, in some embodiments, a pH-modifying fluid (discussed below) may traverse along face 310 towards a portion of oilfield tubular 135. While face 310 is shown as being straight, it is also contemplated that face 310 may be curved in some examples. Whipstock 300 may be made from any suitable material. Suitable materials may include, but are not limited to, metals, nonmetals, polymers, ceramics, and/or combinations thereof. Whipstock 300 may be any suitable size, height, and/or shape. Without limitation, a suitable shape may include, but is not limited to, cross-sectional shapes that are circular, elliptical, triangular, rectangular, square, hexagonal, and/or combinations thereof. In examples, whipstock 300 may be in the shape of an oblique circular cone or wedge. The cross-sectional area may increase from an end 315 with a tip 320 of the oblique circular cone to a base 325. In examples, packer 305 may be coupled to base 325 of whipstock 300.

Packer 305 may be coupled to whipstock 300 using any suitable mechanism, including, but not limited, through the use of suitable fasteners, threading, adhesives, welding and/or any combination thereof. Without limitation, suitable fasteners may include nuts and bolts, washers, screws, pins, sockets, rods and studs, hinges and/or any combination thereof. In examples, a shear pin may couple packer 305 to whipstock 300. Packer 305 may seal off a portion of wellbore 110 (referring to FIG. 1). Once actuated, sealing elements 330 of packer 305 may expand radially into oilfield tubular 135 (referring to FIG. 1). In examples, sealing elements 330 may grip an inner surface of oilfield tubular 135 so as to better seal off a portion of wellbore 110 and restrict hydrocarbon flow.

Figure 4:
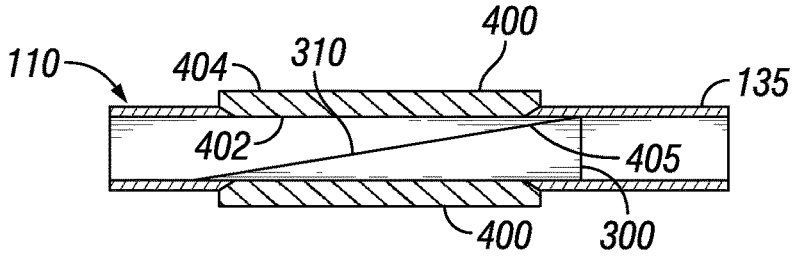
FIG. 4 illustrates an example of a whipstock disposed adjacent a degradable section in a casing.

FIG. 4 illustrates an example of whipstock 300 disposed adjacent a degradable section 400 in oilfield tubular 135. Degradable section 400 may include a different material than the rest of oilfield tubular 135. Degradable section 400 may be a designated portion of oilfield tubular 135 where exit window 115 (e.g., referring to FIG. 1) is to be created.

Degradable section 400 may be made from any suitable degradable material capable of undergoing an irreversible degradation in situ upon contact with the pH-modifying fluid. As used herein, the term "irreversible" mean that degradable material should degrade in situ (i.e., downhole) but should not recrystallize or reconsolidate after degradation. Suitable degradable materials include materials reactive to the pH-modifying fluid (discussed in more detail below), whether by deterioration of the degradable material by dissolution or corrosion. The degradable materials should be inert at ambient condition and should degrade when contacted by other wellbore fluids so that degradation can be activated by exposure to the pH-modifying fluid. In examples, degradation of degradable section 400 may occur at any suitable rate of time. Examples of suitable degradable materials may include, but are not limited to, metals, nonmetals, polymers, ceramics, and/or combinations thereof. Without limitations, the degradable material may include one or more metals, including, but not limited to, aluminum, magnesium, copper, zinc, tin, and/or combinations thereof. In some examples, the degradable material may include aluminum as aluminum may be subject to degradation in both acid and basic environments. For example, degradation of aluminum may occur at both low pH (for example, below 4) and high pH (for example, above 9). Aluminum may also be stable in normal muds and brine so aluminum may not prematurely degrade prior to contact with the pH-modifying fluid. In some embodiments, an inhibitor may be included in well fluids to prevent premature degradation. Suitable inhibitors may include, but are not limited to, sodium polyphosphate and potassium-based compounds. In some embodiments, the dissolvable section 400 may include a coating. The coating may be applied to both interior surface 402 and/or exterior surface 404. The coating may protect the dissolvable window, for example, from other wellbore fluids (e.g., cement slurries) prior to contact with the pH-modifying fluid. Suitable coatings may include, but are not limited to, paints, epoxies, polymers, glass, cements, ceramics, metal depositions, metal cladding, waxes, and/or combinations thereof.

Degradable section 400 may be disposed in-line with oilfield tubular 135. Degradable section 400 may be disposed in-line with oilfield tubular 135 using any suitable mechanism, including, but not limited, through the use of suitable fasteners, threading, adhesives, welding and/or any combination thereof. In examples, section 400 may be thicker than oilfield tubular 135 to compensate for the difference in material properties. For example, degradable section 400 may have a thickness that is greater adjacent portions of casing by 10%, 20%, 30%, or even more. In examples, degradable section 400 may be tubular in shape, wherein the sides of degradable section 400 cover 360 degrees of rotation. In other examples, degradable section 400 may only cover a portion of the circumference of the oilfield tubular 135. The degradable section 400 may have any suitable dimensions. Without limitations, an inner diameter of degradable section 400 may range from about 2.5 inches (6.35 cm) to about 24 inches (60.96 cm) and an outer diameter of degradable window 400 may range from about 2.5 inches (6.35 cm) to about 26 inches (66.04 cm). Without limitation, the thickness of section 400 may range from about ¼ inches (0.635 cm) to about 2 inches (5.08 cm).

In operation, whipstock 300 may be positioned in wellbore 110 adjacent to degradable section 400. The whipstock 300 may be positioned, for example, after completion of wellbore 110 and when it is desired to sidetrack wellbore 110 through degradable section 400. A pH-modifying fluid may then be provided at degradable section 400, for example, by introduction through wellbore 110 to degradable section 400. The whipstock 110 should direct the pH-modifying fluid to degradable section 400. The pH-modifying fluid should degrade material from the degradable section 400, thus forming an exit window 115 (e.g., shown on FIG. 1) in oilfield tubular 135. As illustrated, the whipstock 110 may include a seal 405. The seal 405 may be disposed at edges of face 310 of whipstock 300 so as to minimize the flow of the pH-modifying fluid around the whipstock 110 towards a portion of oilfield tubular 135 wherein it is undesirable to degrade. In examples, seal 405 may engage degradable section 400 to prevent the flow of the pH-modifying fluid to circulate behind whipstock 300. Without limitations, seal 405 may be a swellable elastomer, a foamed elastomer, a compression-set elastomer, a rubber lip, an O-ring, a metal-to-metal seal, and/or combinations thereof. In some examples, the seal 405 is formed by an inner dimension of the degradable section 400 in contact with the edges of the face 310. In some examples, clearance between seal 405 may be created by having an interference fit and/or a close fit around the edges of the face 310. In some examples, a coating may be applied to face 310 of whipstock 300. The coating may be applied, for example, during setting of the whipstock 300 in wellbore 110. Coating may protect face 310 of whipstock 300 from the pH-modifying fluid. In examples, the surface of the whipstock may be coated to minimize the corrosion to whipstock 300 from the pH-modifying fluid. The surface of face 310 may also be coated to reduce the abrasion from any potential milling operations. Suitable coatings for whipstock 300 may include, but are not limited to, paints, epoxies, polymers, glass, cements, ceramics, metal depositions, metal cladding, waxes, and/or combinations thereof.

Figure 5:
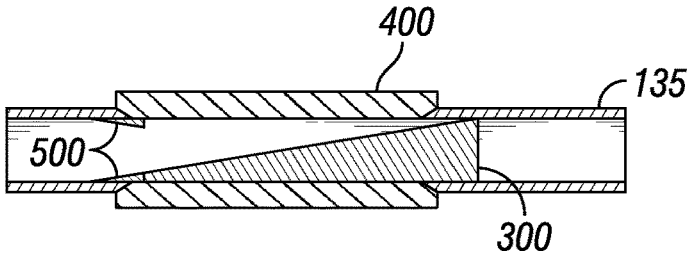
FIG. 5 illustrates another example of a whipstock disposed adjacent a degradable section in a casing.

With reference now to FIG. 5, an alternate example of whipstock 300 disposed adjacent a degradable section 400 in oilfield tubular 135 is illustrated. In the present example, there may be one or more wings 500 disposed at intersection between degradable section 400 and oilfield tubular 135. There may be a plurality of wings 500 employed to protect the mechanism used to join degradable section 400 to oilfield tubular 135 from the pH-modifying fluid. Wing 500 may be made from any suitable material. Suitable materials may include, but are not limited to, metals, nonmetals, polymers, ceramics, and/or combinations thereof. Without limitations, wing 500 may be made of a plastic and/or elastomer. In examples, wing 500 may remain disposed downhole until subsequent drilling operations break apart wing 500. As illustrated, wing 500 may be extend from an end 500 (e.g., proximal end) of whipstock 300. When whipstock 300 is disposed adjacent to degradable section 300, wing 500 may cover the intersection between degradable section 400 and oilfield tubular 135. Wing 500 may be an extension of whipstock 300, for example, wing 500 may be integrally formed with whipstock 300. Alternatively, wing 500 may be attached to whipstock 300.

Figure 6A:
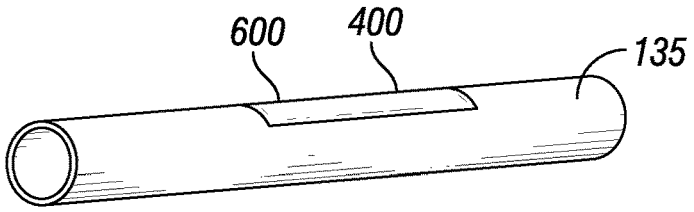
FIG. 6A-6B illustrate an example of a degradable section of a casing.
Figure 6B:
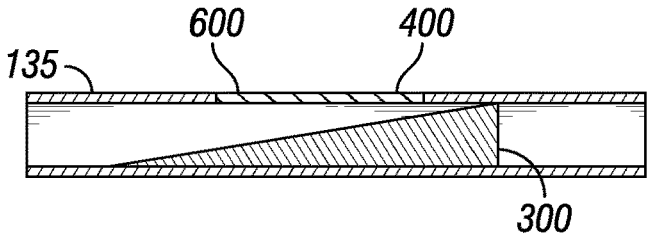

FIG. 6A illustrate another example of degradable section 400 formed in oilfield tubular 135. In the illustrated example, the degradable section 400 is in the form of a degradable window 600 formed in the oilfield tubular 135. By way of example, an opening (obstructed from view by degradable window 600) may be manufactured as a part of oilfield tubular 135. In examples, the opening may then be covered by degradable window 600. Any suitable technique may be used to secure the degradable window 600 in the oilfield tubular 135, for example, fasteners, threading, adhesives, welding and/or any combination thereof. In examples, degradable window may be friction-stir welding to the oilfield tubular 135. In previous examples, degradable section 400 may have been illustrated tubular in shape, wherein the sides of degradable section 400 covered 360 degrees of rotation. In the current example, the width of the curvature of section 400 in the form of degradable window 600 may be a portion of circumference of oilfield tubular 135. Without limitations, the width of the curvature of degradable window 600 may be between from about 20 degrees to about 180 degrees. In examples, the width of the curvature of degradable window 600 may be about 60 degrees. With reference now to FIG. 6B, whipstock 300 is shown disposed adjacent a degradable window 600 in oilfield tubular 135. As illustrated in FIG. 6B, whipstock 300 may have to be oriented, prior to operations, to line up against degradable window 600 so as to prevent exposure of oilfield tubular 135 to the pH-modifying fluid.

Figure 7:
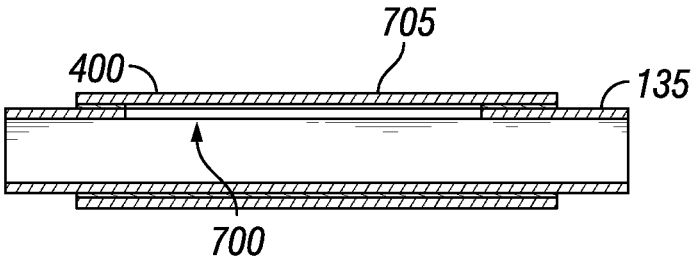
FIG. 7 illustrates an example of a degradable section of a casing.

FIG. 7 illustrates another example of a degradable section 400 formed in oilfield tubular 135. As previously discussed, there may be an opening 700 formed in oilfield tubular 135 for the production of exit window 115 (e.g., referring to FIG. 1). In examples, degradable section 400 may be a sleeve 705 disposed around oilfield tubular 135. Sleeve 705 may cover up the opening 700. Without limitation, sleeve 705 may be secured to oilfield tubular 135 through the use of any suitable mechanism, including, but not limited, through the use of suitable fasteners, threading, adhesives, welding and/or any combination thereof.

Figure 8A:
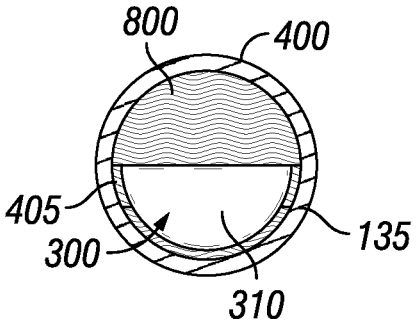
FIGS. 8A-8C illustrate a process of creating an exit window.
Figure 8B:
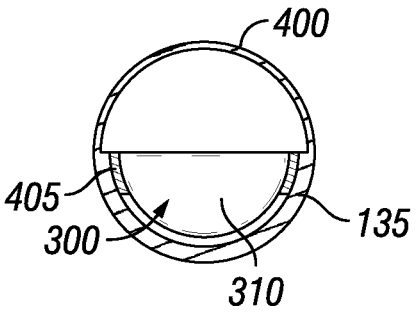
Figure 8C:
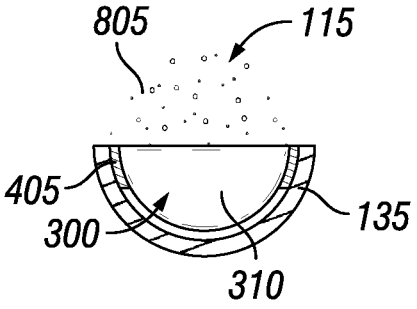

FIGS. 8A-8C illustrate examples of a process for creating exit window 115 in oilfield tubular 135. FIG. 8A illustrates an inner view of oilfield tubular 135. As illustrated, oilfield tubular 135 may include degradable section 400. Whipstock 300 may be disposed in oilfield tubular 135 at degradable section 400. A pH-modifying fluid 800 may then be introduced into oilfield tubular 135 at degradable section 400. Any suitable method may be used to introduce the pH-modifying fluid downhole. Without limitations, the pH-modifying fluid may be run downhole on a wireline in a container, pumped from surface 130 (e.g., referring to FIG. 1) through a separate milling assembly and/or pipe, contained inside and actuated out of whipstock 300, and/or combinations thereof. Face 310 of whipstock 300 may direct pH-modifying fluid 800 into contact with degradable section 400. As illustrated in FIG. 8B, the pH-modifying fluid 800 may react with degradable section 400 to remove material therefrom, for example, through dissolution and/or corrosion. Without limitations, the rate of degradation of degradation section 400 may be from about 0.05 inches (0.127 cm) per hour to about 1 inch (2.5 cm) per hour. In examples, the rate of corrosion may be from about 0.4 inches (1 cm) per hour to about 0.6 inches (1.5 cm) per hour. As previously described, seal 405 may be applied about the edges of face 310 of whipstock 300 to minimize the flow of the pH-modifying fluid 800 towards other portions of oilfield tubular 135. With reference now to FIG. 8C, the pH-modifying fluid may degrade the material of degradable section 400 in order to create exit window 115 in oilfield tubular 135. In examples, once pH-modifying fluid has formed exit window 115, a buffering fluid 805 may be introduced into the oilfield tubular 135 to exit window 115 so as to circulate the pH-modifying fluid away from the remaining portions of degradable section 400. Without limitations, buffering fluid 805 may include a brine, mud, and/or combinations thereof. Alternatively, buffering fluid 805 may include an acidic and/or basic fluid to neutralize the pH-modifying fluid. For example, an acidic fluid may be used in the buffering fluid 805 where the pH-modifying fluid is a base. By way of further example, a basic fluid may be used in the buffering fluid 805 wherein the pH-modifying fluid is an acid. In alternate examples, the process of introducing the pH-modifying fluid downhole to corrode section 400 may be combined with a milling process. For example, the pH-modifying fluid 800 may be used to weaken or otherwise remove material from degradable section 400 while a mill (not shown) may be used to mechanically remove material from the degradable section 400.

Figure 9:
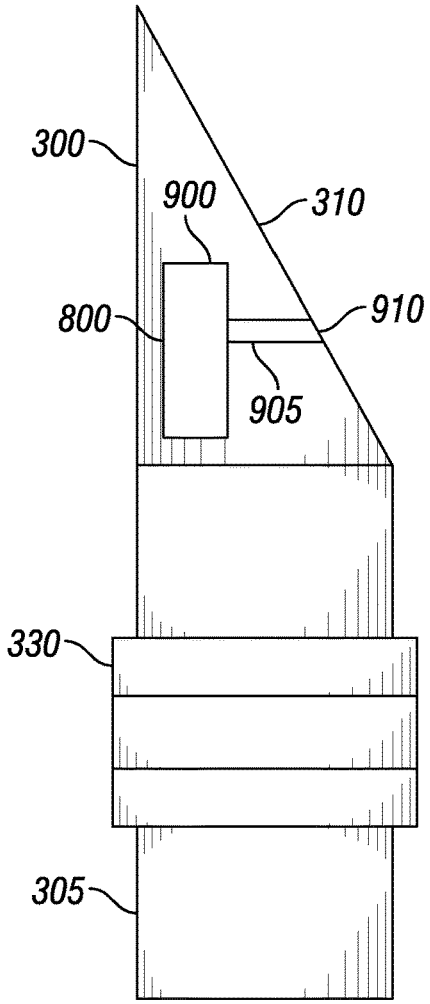
FIG. 9 illustrates another example of whipstock.

FIG. 9 another example of a whipstock 300 that may include an internal chamber 900 for pH-modifying fluid 800. As illustrated, whipstock 300 may include a body 905 that includes at least one face 310. Packer 305 may also be coupled to whipstock 300. Packer 305 may include one or more sealing elements 335. Internal chamber 900 may be formed in body 905 of whipstock 300. Internal chamber 900 may contain pH-modifying fluid 800. Upon actuation, the pH-modifying fluid 800 may be forced from the internal chamber 900 and flow through flow path 905 in body and out port 910 in face 310. In this manner, the pH-modifying fluid 800 may be released from whipstock 300 downhole.

As previously discussed, a pH-modifying fluid 800 may be used to degrade the degradable section 400 (e.g., shown on FIG. 8A). The pH-modifying fluid 800 may be any suitable fluid that can create an environment in contact with the degradable section 400 to facilitate degradation. The pH-modifying fluid 800 is referred to as "pH-modifying" as the environment is created by change of pH. In examples, the pH-modifying fluid 800 may acidic or basic. A pH-modifying fluid 800 that is acidic may have a pH of less than 7 or, alternatively, less than about 4. Where acidic, the pH-modifying fluid may include, but is not limited to, an inorganic and/or an organic acid. Suitable acids may include, but are not limited to, HCl, carboxylic acid, acetic acid, formic acid, gluconic acid, lactic acid, oxalic acid, tartaric acid, and/or combinations thereof. The pH-modifying fluid 800 may be an organic acid or an inorganic acid. In alternate examples, the pH-modifying fluid 800 may include an acid and a brine. The chloride or other halogens in the brine may function with the acid to remove any protective film on the degradable section 400. A pH-modifying fluid 800 that is basic may have a pH of greater than 7 and, alternatively, greater than about 10. Where basic, the pH-modifying fluid may include, but is not limited to, sodium hydroxide, potassium hydroxide, calcium hydroxide, alkoxide, sodium amide, ammonia, and combinations thereof.

Figure 10:
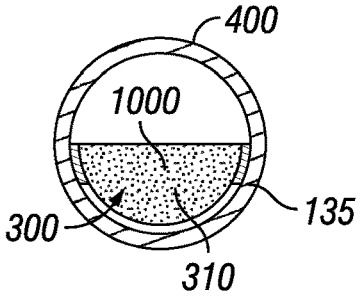
FIG. 10 illustrates yet another example of a whipstock

Alternatively, the pH-modifying fluid 800 may be provided downhole from a suitable anhydrous solid. With reference to FIG. 10, an anhydrous solid 1000 may be disposed on face 310 of whipstock 300. When exposed to wellbore fluids, the anhydrous solid 1000 may hydrolyze and create a suitable fluid in oilfield tubular 135 having a pH value needed to remove material from degradable section 400, shown on FIG. 10 as pH-modifying fluid 800. Suitable anhydrous solids may include, but are not limited to, carboxylic anhydride, acetic anhydride, citric anhydride, Na2O, 1(K2O, CaO, Al2O3, and/or combinations thereof. The present example may be beneficial in that the pH-modifying fluid created downhole would not be exposed to other components in the wellbore besides degradable section 400.

The systems, methods, and apparatus, as described in the present disclosure, may further be characterized by one or more of the following statements.

Statement 1. A method for creating a window in an oilfield tubular, comprising: providing a pH-modifying fluid in the oilfield tubular disposed in a wellbore; and contacting a degradable section of the oilfield tubular with the pH-modifying fluid to degrade at least a portion of the degradable section and form an exit window in the oilfield tubular.

Statement 2. The method of statement 1, wherein the providing the pH-modifying fluid comprises pumping the pH-modifying fluid from a surface through the oilfield tubular to the degradable section.

Statement 3. The method of statement 1 or 2, wherein the providing the pH-modifying fluid comprises actuating the pH-modifying fluid out of a container disposed in the wellbore.

Statement 4. The method of statement 3, wherein the container is a whipstock disposed at the degradable section, wherein the pH-modifying fluid is disposed in an internal chamber in the whipstock.

Statement 5. The method of any of the preceding statements, wherein the providing comprises hydrolyzing an anhydrous solid to generate the pH-modifying fluid in the wellbore.

Statement 6. The method of statement 5, wherein the anhydrous solid is disposed on a face of a whipstock, wherein the whipstock is disposed in the wellbore at the degradable section.

Statement 7. The method of any of the preceding statements, wherein pH-modifying fluid flows along a face of a whipstock disposed at the degradable section to direct the pH-modifying fluid to the degradable section, wherein the face is an inclined ramp.

Statement 8. The method of statement 7, wherein one or more wings extend from an edge of the whipstock to cover an intersection of the degradable section and the oilfield tubular.

Statement 9. The method of statement 7, wherein one or more seals are disposed at edges of the face.

Statement 10. The method of any of the preceding statements, wherein the pH-modifying fluid is basic.

Statement 11. The method of any of the preceding statements, wherein the pH-modifying fluid is acidic.

Statement 12. The method of any of the preceding statements, wherein the degradable section comprises a tubular that is disposed in line with adjacent sections of the oilfield tubular.

Statement 13. The method of any of the preceding statements, wherein the degradable section comprises a sleeve disposed over an opening formed in the oilfield tubular.

Statement 14. The method of any of the preceding statements, wherein the pH-modifying fluid degrades the at least the portion of degradable section at a rate ranging from about 0.05 inches to about 1 inch per hour.

Statement 15. The method of any of the preceding statements, wherein the degradable section comprises a coating to protect the degradable section prior to contact with the pH-modifying fluid.

Statement 16. The method of any of the preceding statements, wherein the degradable section comprises at least one degradable material selected from the group consisting of aluminum, magnesium, copper, zinc, tin, and combinations thereof.

Statement 17. The method of any of the preceding statements, further comprising drilling a secondary wellbore from the wellbore through the exit window.

Statement 18. The method of any of the preceding statements, further comprising milling through the portion of the degradable section while the pH-modifying fluid is in contact with the portion of the degradable section.

Statement 19. A method for creating a window in a casing, comprising: disposing a whipstock in a wellbore adjacent a degradable section of the casing disposed in the wellbore, wherein the degradable section comprises aluminum and is disposed in line with adjacent sections of the casing; and providing an acidic fluid in the casing at the degradable section to degrade at least a portion of the degradable section and form an exit window in the casing.

Statement 20. The method of statement 19, further comprising drilling a secondary wellbore from the wellbore through the exit window.

To facilitate a better understanding of the present disclosure, the following examples of certain aspects of some of the systems and methods are given. In no way should the following examples be read to limit, or define, the entire scope of the disclosure.

EXAMPLE 1

Figure 11:
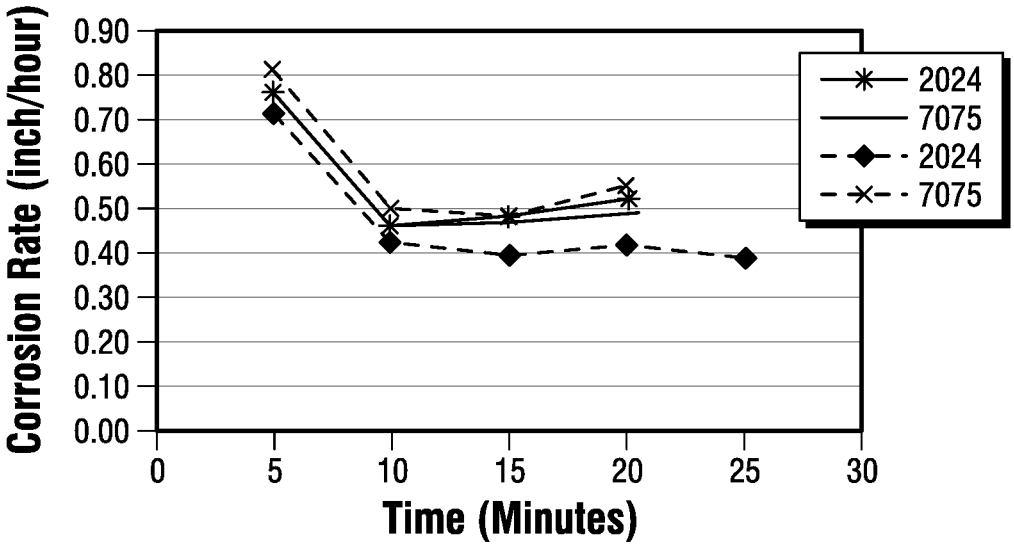
FIG. 11 illustrates a graph of corrosion rates of various material grades.
Figure 12:
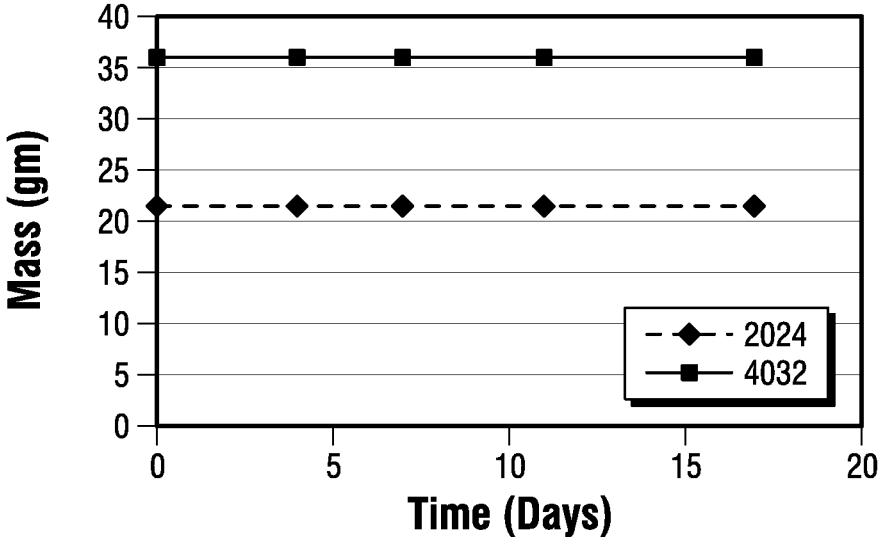
FIG. 12 illustrates a graph of the change in mass of different material grades.

Tests were run to determine the rate at which different grades of aluminum would degrade in an acidic environment. The tests were performed in different weight concentrations of HCL at 150° F. (66° C.). The results of the tests are provided in FIG. 11 and the data collected for each testing scenario are provided in Table 1 below:

TABLE 1

| Sample Grade | Concentration of HCL | Corrosion Rate (inch/hour) | Time (minutes) |
|---|---|---|---|
| 2024 Al | 28% | 0.75 | 5 |
| 2024 Al | 28% | 0.45 | 10 |
| 2024 Al | 28% | 0.48 | 15 |
| 2024 Al | 28% | 0.51 | 20 |
| 2024 Al | 28% | N/A | 25 |
| 7075 Al | 28% | 0.75 | 5 |
| 7075 Al | 28% | 0.45 | 10 |
| 7075 Al | 28% | 0.48 | 15 |
| 7075 Al | 28% | 0.49 | 20 |
| 7075 Al | 28% | N/A | 25 |
| 2024 Al | 18% | 0.70 | 5 |
| 2024 Al | 18% | 0.41 | 10 |
| 2024 Al | 18% | 0.40 | 15 |
| 2024 Al | 18% | 0.41 | 20 |
| 2024 Al | 18% | 0.39 | 25 |
| 7075 Al | 18% | 0.80 | 5 |
| 7075 Al | 18% | 0.49 | 10 |
| 7075 Al | 18% | 0.48 | 15 |
| 7075 Al | 18% | 0.55 | 20 |
| 7075 Al | 18% | N/A | 25 |

EXAMPLE 2

Typically, aluminum is stable in normal muds and brines. Aluminum drill pipe has been operated in natural muds with pH range from 7 to 10, including muds containing NaCl up to 25,000 ppm with pH range from 7 to 10.5, salt muds containing up to 180,000 ppm NaCl with pH range from 7.5 to 9, and oil-based mud. Change in mass tests were run to determine the impact of a common completion brine on different grades of aluminum. The tests were performed in a concentration of 15% KCL by weight at 194° F. (90° C.). The results of the tests are provided in FIG. 11, and the data collected for each testing scenario are provided in Table 2 below:

TABLE 2

| Sample Grade | Mass (gm) | Time (days) |
|---|---|---|
| 2024 Al | 22 | 0 |
| 2024 Al | 22 | 4 |

TABLE 2-continued

| Sample Grade | Mass (gm) | Time (days) |
|---|---|---|
| 2024 Al | 22 | 7 |
| 2024 Al | 22 | 11 |
| 2024 Al | 22 | 16 |
| 4032 Al | 36 | 0 |
| 4032 Al | 36 | 4 |
| 4032 Al | 36 | 7 |
| 4032 Al | 36 | 11 |
| 4032 Al | 36 | 16 |

As illustrated, the aluminum did not degrade when exposed to a common completion brine (15% KCL).

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for creating a window in an oilfield tubular, comprising:

providing a pH-modifying fluid in the oilfield tubular disposed in a wellbore; and directing, with a whipstock, the pH-modifying fluid to contact a degradable section of the oilfield tubular to degrade at least a portion of the degradable section and form an exit window in the oilfield tubular, wherein the whipstock is adjacent to the degradable section and disposed within the oilfield tubular, wherein a seal is disposed at edges of a face of the whipstock between the face and the degradable section.

2. The method of claim 1, wherein the providing the pH-modifying fluid comprises pumping the pH-modifying fluid from a surface through the oilfield tubular to the degradable section.

3. The method of claim 1, wherein the providing the pH-modifying fluid comprises actuating the pH-modifying fluid out of a container disposed in the wellbore.

4. The method of claim 3, wherein the container is the whipstock, wherein the pH-modifying fluid is disposed in an internal chamber in the whipstock.

5. The method of claim 1, wherein the providing comprises hydrolyzing an anhydrous solid to generate the pH-modifying fluid in the wellbore.

6. The method of claim 5, wherein the anhydrous solid is disposed on the face of the whipstock.

7. The method of claim 1, wherein pH-modifying fluid flows along the face of the whipstock, wherein the face is an inclined ramp.

8. The method of claim 7, wherein one or more wings extend from an edge of the whipstock to cover an intersection of the degradable section and the oilfield tubular.

9. The method of claim 1, wherein the seal comprises a swellable elastomer, a foamed elastomer, a compression set elastomer, a rubber lip, an O-ring, a metal-to-metal seal, or combinations thereof.

10. The method of claim 1, wherein the pH-modifying fluid is basic.

11. The method of claim 1, wherein the pH-modifying fluid is acidic.

12. The method of claim 1, wherein the degradable section comprises a tubular that is disposed in line with adjacent sections of the oilfield tubular.

13. The method of claim 1, wherein the degradable section comprises a sleeve disposed over an opening formed in the oilfield tubular.

14. The method of claim 1, wherein the pH-modifying fluid degrades a portion of the degradable section at a rate ranging from about 0.05 inches to about 1 inch per hour.

15. The method of claim 1, wherein the degradable section comprises a coating to protect the degradable section prior to contact with the pH-modifying fluid.

16. The method of claim 1, wherein the degradable section comprises at least one degradable material selected from the group consisting of aluminum, magnesium, copper, zinc, tin, and combinations thereof.

17. The method of claim 1, further comprising drilling a secondary wellbore from the wellbore through the exit window.

18. The method of claim 1, further comprising milling through the portion of the degradable section while the pH-modifying fluid is in contact with the portion of the degradable section.

19. A method for creating a window in a casing, comprising:

disposing a whipstock in casing that is positioned in a wellbore, wherein the whipstock is adjacent to a degradable section of the casing, wherein a seal is disposed at edges of a face of the whipstock between the face and the degradable section, wherein the degradable section comprises aluminum and is disposed in line with adjacent sections of the casing; and providing an acidic fluid in the casing at the degradable section to degrade at least a portion of the degradable section and form an exit window in the casing.

20. The method of claim 19, further comprising drilling a secondary wellbore from the wellbore through the exit window.

* * * * *